US005174608A

United States Patent [19]

Benardelli

[11] Patent Number: 5,174,608

[45] Date of Patent: Dec. 29, 1992

[54] TRANSPARENT TAMPERPROOF SEAL FOR THE PROTECTION OF SIGNED TEXTS AND DOCUMENTS

[75] Inventor: Giovanni Benardelli, Meride, Switzerland

[73] Assignee: Arysearch Arylan AG, Liechtenstein, Switzerland

[21] Appl. No.: 819,096

[22] Filed: Jan. 9, 1992

[30] Foreign Application Priority Data

Jan. 16, 1991 [IT] Italy ..... MI91 A 00082
Apr. 24, 1991 [IT] Italy ..... MI91 U 000364

[51] Int. Cl.[5] ..... B42D 15/00

[52] U.S. Cl. ..... 283/81; 283/72; 283/108; 283/109; 428/40; 428/915; 428/916

[58] Field of Search ..... 283/81, 72, 94, 101, 283/108, 107, 109, 901; 428/40, 915, 916

[56] References Cited

U.S. PATENT DOCUMENTS

| | | | |
|---|---|---|---|
| 4,228,425 | 10/1980 | Cooke | 283/108 X |
| 4,496,961 | 1/1985 | Devrient | 283/72 X |
| 4,608,288 | 8/1986 | Spindler | 283/94 X |
| 4,940,690 | 7/1990 | Skees | 283/901 X |
| 4,968,063 | 11/1990 | McConville et al. | 283/72 |
| 4,976,456 | 12/1990 | Jack | 283/901 |
| 5,020,831 | 6/1991 | Benardelli | 283/72 X |

*Primary Examiner*—Timothy V. Eley

*Assistant Examiner*—Willmon Fridie, Jr.

*Attorney, Agent, or Firm*—Scully, Scott, Murphy & Presser

[57] ABSTRACT

A transparent, tamperproof seal which is utilized for the protection of signed texts and documents. The tamperproof transparent seal for signed texts or documents, inclusive of checks, is constituted of at least one card having on one side thereof, an adhesive inking and varnishing multilayer lamina which is at least partially transparent, and with a suitable movable sheet-like carrier or substrate consisting of a transparent plastic material; and on the other side, possessing a delayed-action adhesive selected from a group of pressure-sensitive adhesives, and which is protected by a liner, heat-activated adhesives and wet-activated adhesives. The lamina is intended to be applied onto the text with the subsequent removal of the carrier; with an identical number with prefix, set in a position chosen being present within and outside the confines of the seal, the lamina bearing a number with a prefix, providing an attestation, and an adjacent background covering stripe, upon which number and stripe there is to be superimposed the signature, the number of the seal being shown by means of a non-impact printing device in a preestablished sequence so as to be individualized and clearly evident, while the prefix, which is generally alphabetical, is obtained by an ink transference upon detaching the carrier.

15 Claims, 4 Drawing Sheets

TRANSPARENT TAMPERPROOF SEAL FOR THE PROTECTION OF SIGNED TEXTS AND DOCUMENTS

BACKGROUND OF THE INVENTION

1. Field of the Invention

The present invention relates to a transparent, tamperproof seal which is utilized for the protection of signed texts and documents.

In view of an increase in the incidences of counterfeiting of hand-written or typed texts and information, including but not limited to personal checks, accounts payable checks and bank checks, and of various types of documents, including identity documents such as passports, identity cards and drivers licenses, it is considered to be necessary to impart an evidence of authenticity to the contents of such texts and documents, especially when these are endorsed by signature.

2. Discussion of the Prior Art

All attempts which have been carried out until this time to impart a transparent surface protection to texts and documents through the intermediary of devices such as adhesive tapes, vinyl films, dyes and the like, have not provided satisfactory results, particularly in relationship to the possibility of removing, at either high or low temperatures, the protective layer from the document, maintaining the removed film intact and thereby reusable, and moreover to the fact, that it is not possible to ascribe the application of such a protective device to the signer of the authentic text, for instance the drawer of a check.

SUMMARY OF THE INVENTION

Accordingly, the present invention, in order to improve upon the state-of-the-art resides in imparting to the most important passages of a text or document a surface protection which is capable of being able to reveal any encountered alteration, and is adapted to verify the authenticity of such text or document as long as such protection remains visibly intact.

It is a primary object of the present invention to provide a tamperproof transparent seal for signed texts or documents, inclusive of checks, in that it is constituted of at least one card having on one side thereof, an adhesive inking and varnishing multilayer lamina which is at least partially transparent, and with a suitable movable sheet-like carrier or substrate consisting of a transparent plastic material; and on the other side, possessing a delayed-action adhesive selected from a group of pressure-sensitive adhesives, and which is protected by a liner, heat-activated adhesives and wet-activated adhesives. The lamina is intended to be applied onto the text with the subsequent removal of the carrier; with an identical number with prefix, set in a position chosen being present within and outside the confines of the seal, the lamina bearing a number with a prefix, providing an attestation, and an adjacent background covering stripe, upon which number and stripe there is to be superimposed the signature, the number of the seal being shown by means of a non-impact printing device in a preestablished sequence so as to be individualized and clearly evident, while the prefix, which is generally alphabetical, is obtained by an ink transference upon detaching the carrier. Preferably the numbers of the seal are obtained through a computerized ink jet head.

The presence of the background covering stripe is required in order to render the superimposition of the signature, upon such stripe and upon the witness number, evident and unmistakable in nature. Through the mechanism in the application of the seal so as to attain the object of the present invention, there can thus be verified that the seal has been applied by and, in essence, belongs to the signer of the text or document; for instance, a check and this by reason of the identity of the number with prefix acting as an attestation that is validated by the superimposed signature, with the number and prefix which is to be read being on the seal or outside of the latter.

Another embodiment of the present invention contemplates the provision of a tamperproof seal which is especially adapted for the protection of the authenticity of the written text on a check. The seal essentially consists of three cards, one of which is larger and two, which are to be used alternatively on the signature line of either negotiable and non-negotiable checks, are smaller in size, with the larger card being provided with a transparent adhesive inking and varnishing multilayer lamina, and the other two smaller cards with analogous laminas; however, being partially transparent and with each lamina, positioned on a carrier, bearing an identical number with a prefix and a liner. The adhesive inking and varnishing multilayer lamina of the larger card is adapted to be applied onto the check, with the subsequent removal of the carrier, in order to protect the authenticity of the letters, the currency specification and the beneficiary's or payee's name; whereas the adhesive inking and varnishing multilayer lamina of the second card, which is selected between the two smaller ones, is intended to be applied, with the subsequent removal of the carrier, onto the area of the signature which is then to be directly superimposed by the drawer of the check onto the lamina upon both the number with prefix, providing an attestation, and over the adjacent background covering stripe; with the adhesive inking and varnishing multilayer lamina of the third card being then applied, after implementing the removal of the carrier, onto the check stub for recording purposes.

According to the invention, the seals having more than one card are designed so as to be constituted from partly die cut cards which are temporarily combined along their sides or edges to form a single piece or stripe. Consequently, the liner instead of being constituted from a single piece may be resultingly subdivided into partly die cut portions.

For purposes of conciseness, the term "text", also employed in the plural form in the present application, is deemed to also include the terms "document" and "check", as employed hereinbelow.

The adhesive inking and varnishing multilayered lamina of the larger card which is to be applied onto the text is distinguished on the surface thereof by a transparent varnishing layer which reveals a characterizing micro-embossed pattern; in effect, which becomes visible only upon the detachment of the carrier or substrate. Such a characterizing micro-embossed pattern affords the advantage of obstructing any counterfeiting of the seal per se, as well as any duplication of the sealed document by photostatic processes.

In particular for checks, the adhesive inking and varnishing multilayer lamina of one of the two smaller cards which is to be alternatively applied on the signature line, bears the lettering "NOT NEGOTIABLE". In such a case, the lamina with this legend presents a symbol in proximity with the number with the prefix, essentially providing an attestation, recalling the "non-negotiable" character of the check, which is a protection of the drawer's signature. The alphabetic prefix, which may be generally formed from two letters, is obtained by ink transference as is disclosed in European Patent Appln. No. 89 81 0541.6, filed on Jul. 17, 1989, and which is assigned to the present Applicant, cocerning the selective ink transfer from one substrate to another.

A further embodiment of the present invention comprises a transparent tamperproof seal, as described hereinbelow in detail for personal checks, accounts payable checks and bank checks designed as the complementary part of a blank check and bearing a witness number with a prefix, as well as an adjoining background covering stripe, adapted to match the number of the check. Inasmuch as blank checks may easily be objects of theft and of fraudulent uses, the seal and the therewith associated check, are intended to be separately delivered to the owner of the account, who is requested to apply the seal to the check when issuing the latter. The blank check must bear a sign consisting of one or more letters, usually of a specific color or the like, so as to indicate that the check is void in the absence of an identically numbered seal.

A further embodiment of the present invention comprises a transparent tamperproof seal which is to be automatically applied onto presigned cashiers or bank checks, which is distinguished in that it is constituted from a single card which, in addition to the carrier, includes a single transparent adhesive inking and varnishing multilayer lamina with an attesting number and prefix which match the number of the bank check onto which it is applied; and with the lamina comprising an adhesive coating which is activated prior to its use by means of heat or moisture.

A further embodiment of the invention consists in the provision of a transparent tamperproof seal which is especially adapted to be applied to identity documents, such as passports, drivers licenses and the like, and is constituted from a single card comprising, in addition to a carrier and a linear, a single partly transparent adhesive inking and varnishing multilayer lamina, bearing two numbers which are identical with the number of the document one of which numbers is placed, at least in part, upon a photograph on the document and the other, thereby acting as a verification or attesting number, appearing beneath the signature of an authority issuing the document, and that the latter is in order so as to demonstrate the validity and authenticity of the document through the correspondence in the numbering between the document and the seal.

The adhesive inking and varnishing multilayer laminas, located on a carrier, essentially comprise the following layers:

(a) a transparent varnishing layer which is applied onto the respective carrier and is microembossed only in the region of the larger card;

(b) at least one inking layer which is lightly pigmented by means of screen printing;

(c) points or dots or pigmented ink in solution, preferably ejected from a computerized head, in order to impart to each multilayer lamina at least the respective applicable number;

(d) and a discontinuous layer of a transparent adhesive coating separate zones and designed to maintain its tack at temperatures of from −40° Celsius degree up to +100° Celsius. The adhesive inking and varnishing multilayer laminas of a least the larger card and the smaller card possessing the lettering "NOT NEGOTIABLE", incorporate other two layers below the adhesive layer and the point or dot-formed numbers, respectively constituted of tracings or plots of soft and undryable black ink, in order to form a guiding line for the correct positioning of the seal on the check for document and the lettering on the smaller lamina, such ink being subject to spreading over the surface of the paper under mechanical pressure or erasing on the surface, and by a slightly pigmented anti-scratch varnish, which is reactive to Wood light.

A further embodiment of the present invention is represented by a tamperproof seal which is adapted to be more easily manually applied onto large quantities of checks; with the seal being characterized in that it consists of a single stripe comprising at least two cards, one of which is larger and generally rectangular; and with their laminas being longitudinally joined through partial die cuts and provided, on one side thereof, with a transparent carrier, and on the other side thereof with the adhesive.

When the seal is protected by a liner, the larger lamina is to be positioned, after removing the liner, on the amount set forth in written letters, the currency specification and the beneficiary's or payee's name on the check, and then is to have the carrier removed therefrom by lifting the carrier away from the side of the smaller card which is still protected by the liner. The smaller lamina, once the liner is provided relative thereto is removed therefrom, is then adapted to be applied on the signature line, and thereafter has the carrier removed therefrom. Finally, the signature of the drawer of the check is to be extended over both the number with prefix, providing an attesting or authentication, as is indicated on the smaller lamina and the neighboring background covering stripe.

The above seal, which can be rapidly applied to the check by hand, may incorporate another smaller card, so that is consists of three cards which are longitudinally joined and respectively provided with liners. The third lamina, which is not intended to be applied onto the check, can be placed on the check stub and then its carrier, which have been already detached.

When the seal, which consists of two cards as maintained hereinabove, is automatically applied onto the checks, it is necessary that instead of the pressure-sensitive adhesive which ordinarily has to be protected by a liner, to utilize a heat-activated adhesive. It is also possible that instead of a heat-activated adhesive, there be employed a moisture-activated adhesive.

The slightly pigmented varnishing layer of the seal, which is incorporated in the inking and varnishing multilayer lamina, can consist of different colors in order to distinguish the denomination, namely the maximum value, of a bank check.

In actual practice, the application of the seal pursuant to the present invention is intended to be unmistakably ascribed to the signer of the authentic text; for instance, the drawer of a check, and by virtue thereof, the seal radically differs from any other kind of device employed for the mechanical protection of the text, such as transparent tapes, vinyl films, dyes and the like, the foregoing of which are easily removable at low or high temperatures and repositionable on the text, for instance, such as on a check after imparting any desired alterations thereto.

BRIEF DESCRIPTION OF THE DRAWINGS

The present invention may now be more clearly understood by referring to the following detailed description of preferred embodiments thereof, taken in conjunction with the accompanying drawings; in which.

DETAILED DESCRIPTION OF PREFERRED EMBODIMENTS

Figure 1A:
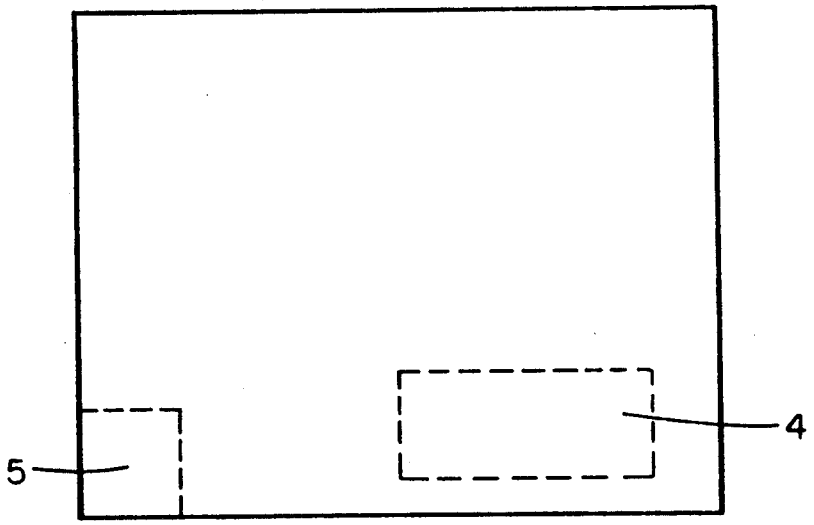
FIGS. 1*a* and 1*b* illustrate, respectively, a top plan view and a side view of a seal with a single lamina constructed pursuant to the invention.
Figure 1B:
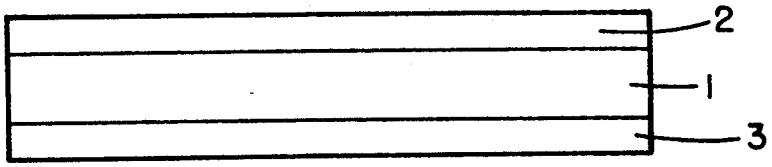

A seal, as is represented in FIGS. 1*a* and 1*b* of the drawings, and is generally adapted for the protection of texts, is constituted of a single card comprising an adhesive inking and varnishing multi-layer lamina 1, which is partially transparent, and has a transparent carrier or substrate 2 o one side thereof and a liner 3 on the other side for the protection of the adhesive layer (not shown in the drawing), wherein the liner 3 is coated on the lamina 1.

For purposes of clarity, the top plan view of FIG. 1 and of the subsequent similar figures are described as showing the various laminas, although each lamina is mounted on a carrier; this being possible due to the transparency of each carrier. Reference numeral 4 indicates the attesting or verifying number, which is preferably obtained by means of a computerized ink jet head, while numeral 5 designates the alphabetic prefix of the number, which becomes legible only upon the stripping off the carrier and is obtained by a selective ink transference pursuant to the process described in European Patent Appln. No. 89 810541.6, as mentioned hereinbefore. The other number may be visible either on the seal or outside of the seal. After removing the liner 3, the seal, in effect, the adhesive lamina 1, is applied onto the text which is to be protected and the carrier 2 is then detached. The signature is now superimposed upon both the number with the alphabetic prefix, effective as an attestation, and the background covering stripe, which for the sake of simplicity is considered in all embodiments as contained within the rectangle indicative of the attestation or verification number (superimposed by the signature) which must match with another identical number which is located, for instance, outside of the seal.

Figure 2A:
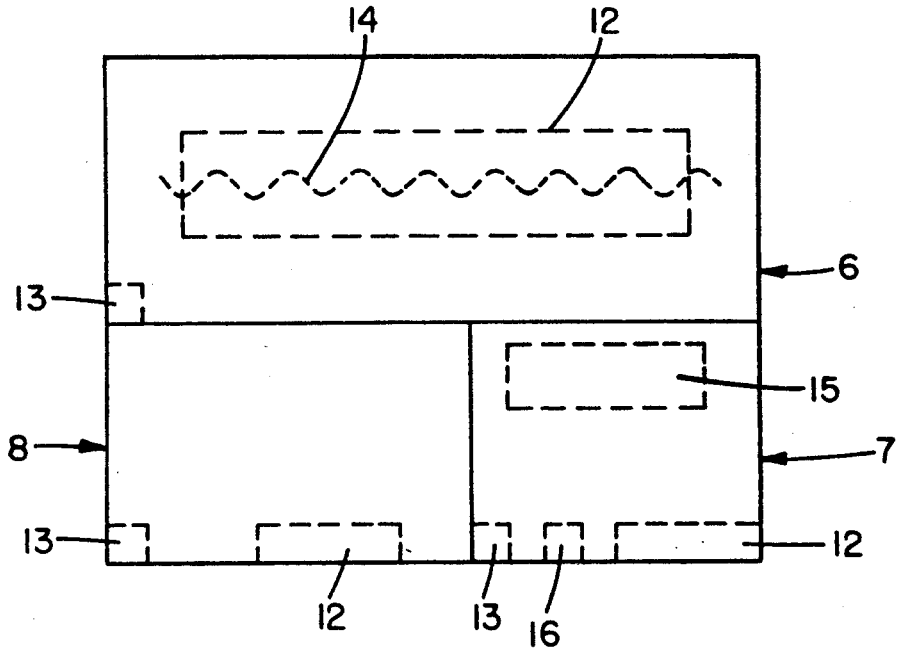
FIG. 2*a*, 2*b* and 2*c* illustrate, respectively, a top plan view and two side views of the two sides of another embodiment of the invention.
Figure 2B:
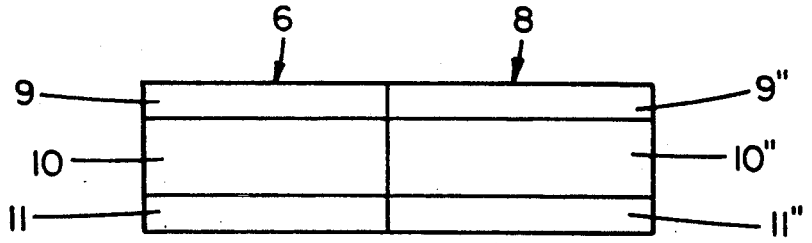
Figure 2C:
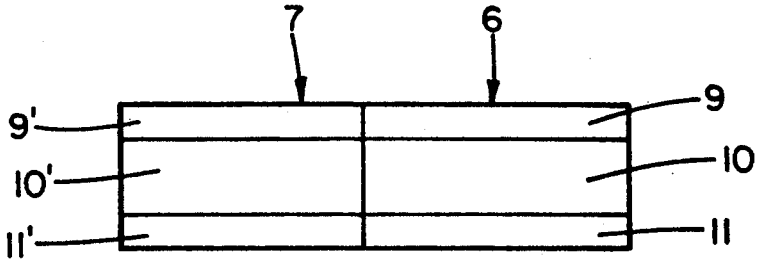

The seal, as illustrated in FIGS. 2*a*, 2*b* and 2*c*, of which FIG. 2*b* is a left side view and FIG. 2*c* is a right side view, is composed of three cards 6, 7 and 8 each of which, respectively, are constituted of carriers consisting of sheet-like transparent plastic material 9, 9' and 9'' and of adhesive inking and varnishing multilayer laminas 10, 10' and 10'' which adhere to the respective liners 11, 11', 11'' protecting the adhesive layer. An identical number identifies each lamina of the cards 6, 7 and 8. The three cards are partially die cut so that they are temporarily connected with each other to form a single stripe. While lamina 10 is transparent, laminas 10' and 10'' are partially opaque because of the presence of the background covering stripe which is proximate to the number. This number is constituted also in this instance of an alphabetic prefix 13, preferably including two serial letters, which is normally placed in a corner of each lamina, and of the complementary number 12. This prefix is obtained by means of an ink transference according to the aforementioned European Patent Appln. No. 89 810541.6, while the number is preferably obtained through the intermediary of a computerized ink jet head which with practically complete certainty eliminates any chance of duplication of number.

The adhesive inking and varnishing multilayer lamina 10 of the larger card 6 presence a guiding line 14 in the center thereof so as to facilitate the correct positioning of the seal on the check, namely located on the writing out in full of the amount in letters and on the payee's or beneficiary's name.

Card 6 is presently applied to the check after removing the liner 11 in order to carefully position the guiding line 14 as above indicated, and subsequent to exerting a due pressure on the seal, the applicable carrier 9 is pulled off the face of the check so that the multilayer inking lamina 10 adheres to the surface of the check.

The card which is to be applied on the signature line is selected between two versions 7 and 8, respectively with or without the legend "NOT NEGOTIABLE" which is incorporated in the area 15. This legend in proximity with the verifying number with the prefix, represents an accessory symbol 16 which may be obtained, for instance, by means of a computerized ink jet head such that even in the event of a potential counterfeiter succeeding in eradicating the legend without any spreading of black ink on the face of the check, the intention of the drawer to render the title not negotiable is in any case attested to by this symbol, since it is located ineradicatably beneath the signature of the drawer.

The smaller lamina 10' of card 7 bearing this legend 15 is intended to be applied to the check prior to signing by the drawer, after removing liner 11 and positioning the relevant attestation number 12 with the prefix 13 on the signature line of the same check. Upon detaching the carrier 9', the drawer must superimpose his signature on the number 12, called the attestation or verifying number of the smaller lamina 10', accompanied by the prefix 13, as well as upon the symbol mark 16 and the background covering stripe. In effectuating the foregoing, the correspondence of the attestation number with its prefix of the applied lamina 10' with the identical number of the applied larger lamina 10, assures the bearer of the check under all circumstances that the seal which appears on the written-out amount in letters, the currency specification and the name of the payee, was applied by the drawer in order to protect the authenticity of the text and, as a consequence, that no alterations could have been subsequently made.

In this embodiment of the invention, the remaining lamina 10'' of card 8 which is not utilized on the check per se is adapted to be applied on the check stub after removing the liner 11'', in order to register the number of the seal which is indicated in this lamina 10''; and with the carrier 9'' being eventually removed.

The numerical correspondence with the foregoing consists of in that the number 12 with the prefix 13, which is displayed on the smaller inking multilayer lamina and is located beneath the signature of the drawer, thereby becoming an attestation or verifying number, must conform with the number 12 and prefix 13 which are legible on the larger inking multilayer lamina of the seal protecting the amount in the written-out letters, the currency specification and the name of the payee.

The smaller lamina with the lettering featuring "NOT NEGOTIABLE" proximate the attestation number, the symbol 16, which is in actuality not incorporated in the other smaller card which is alternatively employed on the signature line and which is similarly obtained by means of a computerized ink jet head, such that even in the event a counterfeiter succeeded in erasing the lettering, the presence of the symbol in a tamper-proof ineradicable position; namely, beneath the signature of the drawer, would make a cashier aware of the apparently illicit action. The adhesive inking and varnishing multilayer lamina, which is constituted of a very thin film, once the carrier has been removed, protects the amount written out in letters, the currency specification and the name of the payee without altering the graphic pattern of the check. This adhesive lamina can not be removed from the face of the check in order to effectuate an alteration in the text with a subsequent repositioning of the seal, since it is constituted of n inking and varnishing multilayer which is insubstantial in physical size so that it is subject to being ripped into small fragment when removed. Furthermore, the characterizing micro-embossed patterns which are impressed into the surface of the inking and varnishing multilayer lamina of the larger card are completely invisible on the marketed product, whereas they are easily inspectable under incident white light after the application of the lamina to the check and the removal of the applicable carrier. These characterizing micro-embossed patterns are photostatically unduplicable and prevent the reproduction of the seal by means of a scanner or an intelligent copier.

The entire surface of the seal is reactive to light, such as a Wood light, in order to expose any kind of possible erasures, scratches and abrasions on the inking multilayer lamina which can be produced by a counterfeiter during an attempt in alternating the text. For accomplishing the same purpose, the transparent varnishing layer is similarly slightly pigmented in order to allow for the same inspection under incident white light. Furthermore, after removing the carrier, such a lamina is singled out by the presence of an individual and unmistakably sequential number which is preferably obtained by means of a computerized ink jet head. Even the signature of the drawer cannot be photostatically replicated inasmuch as it is inseparable from the attestation or verifying number and the applicable prefix of the lamina which is applied on the signature line.

Figure 3A:
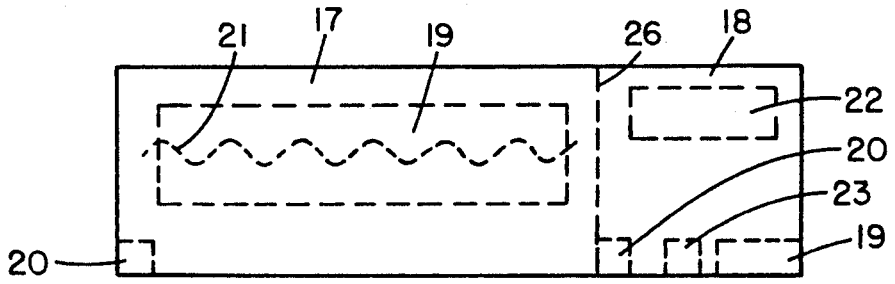
FIGS. 3*a* and 3*b* illustrate, respectively, a top plan view and a front view of a further embodiment of the invention.
Figure 3B:
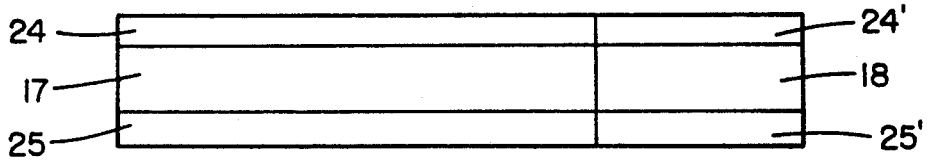

The seal described in FIGS. 3*a* and 3*b* is designed for non-negotiable personal checks, accounts-payable checks and band checks, and is made of a stripe constituted of two cards having, respectively, a larger rectangular lamina 17 and a smaller lamina 18; with the cards being longitudinally joined through a partial die cut extending along lien 26 so as to form a single strip bearing the lettering "NOT NEGOTIABLE", as is indicated by the area 22. The areas for the number and for the relative alphabetic prefix are respectively indicated by reference numerals 19 and 20, while the symbol which is related to the lettering is identified by 23. The larger lamina incorporates a line 21 for the correct positioning of the lamina on the text of the check. Reference numerals 24 and 24', respectively, identify the carriers of the laminas; 25 and 25', respectively, indicate the applicable liners.

Furthermore, FIG. 3*b* sets forth the directions for the application of the seal on the check. Holding the part of the seal corresponding to the card comprising lamina 18, the larger lamina 17 after removing its liner 25 is positioned over the writing on the check; thereupon lifting the same card corresponding to lamina 18, which has not yet been applied, the carrier 24 is removed. Holding the carrier portion 24, which has been stripped off lamina 17, lamina 18, after removing the applicable liner 25', is applied over the signature line and at the end carrier 24', which is still joined to carrier 24 which has been already detached, is then stripped off. The carriers are presently joined together by a partial die cut extending along line 26. In effecting the foregoing, there is no contact between the hand of a person and the adhesive. The signature of the drawer is to be superimposed on the attestation number 19 with prefix 20 and on the adjacent background covering stripe of lamina 18.

Figure 4A:
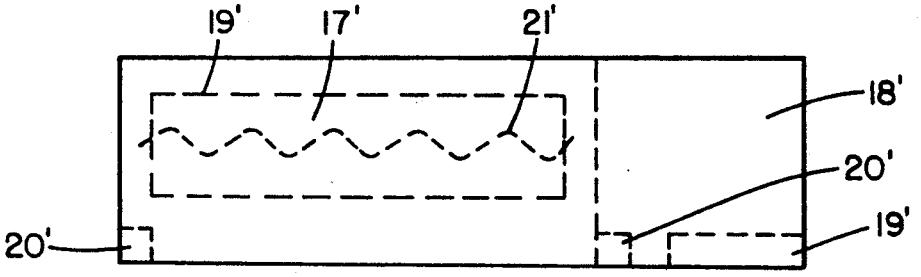
FIGS. 4*a* and 4*b* illustrate, respectively, a top view and a front view of another embodiment of the invention.
Figure 4B:
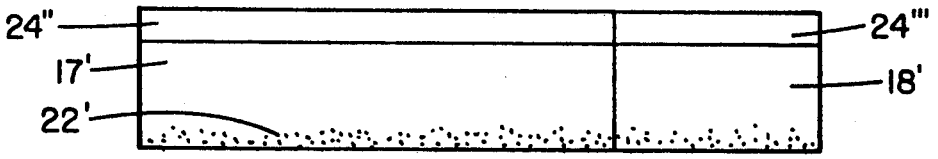

FIGS. 4*a* and 4*b* differ from the embodiment of FIGS. 3*a* and 3*b* in that they represent a seal in the form of one stripe of two cards with two laminas designed for negotiable personal checks, accounts payable checks and bank checks. In these drawing figures the smaller lamina actually does not bear either the lettering "NOT NEGOTIABLE" or the symbol mark related to that lettering. The figures show the larger rectangular lamina 17' which is longitudinally joined to the smaller lamina 18', both laminas having mounted thereon the respective carriers 24' and 24''. The areas for the attestation or verifying number and the alphabetic prefix are respectively indicated by reference numerals 19' and 20'. The reference number 19' for the smaller lamina 18' is the attestation number upon which the signature of the drawer is to be superimposed. Reference numeral 21' indicates the guiding line for enabling a correct positioning of the seal on the check. The joined carriers 24'' and 24''' maintain the laminas 17' and 18' together. FIG. 4*b* discloses an activated adhesive 22'; for instance, a heat-activated adhesive which does not require the protection of a liner since it is heat activated during the automatic application of the seal to the check.

Figure 5:
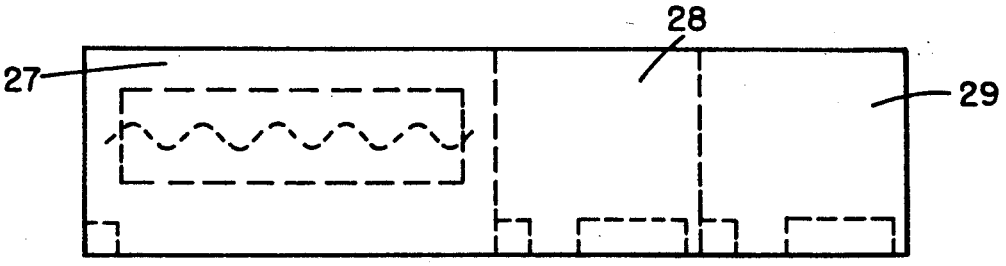
FIG. 5 illustrates a top plan view of still another embodiment of the invention.

FIG. 5 represents a seal with a larger lamina 27 and two small laminas 28 and 29 which are longitudinally joined along the same side of the larger lamina and are supported by respective carriers. The two smaller laminas can just as well be respectively located on opposite sides of the larger lamina.

Figure 6:
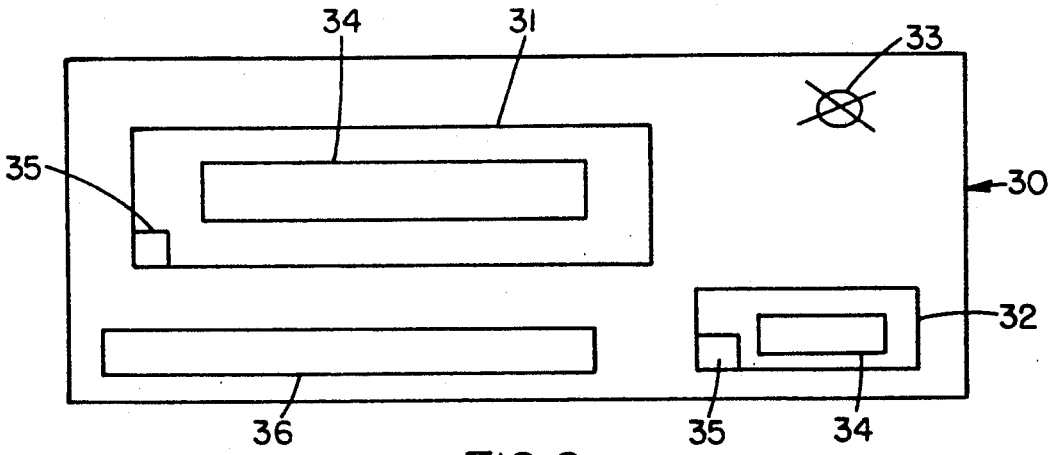
FIG. 6 illustrates a top plan view of yet another embodiment of the invention.
Figure 7A:
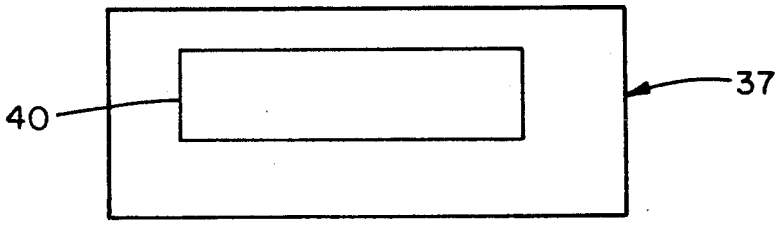
FIGS. 7*a* and 7*b* illustrate, respectively, a top plan view and a front view of a further embodiment of the invention.
Figure 7B:
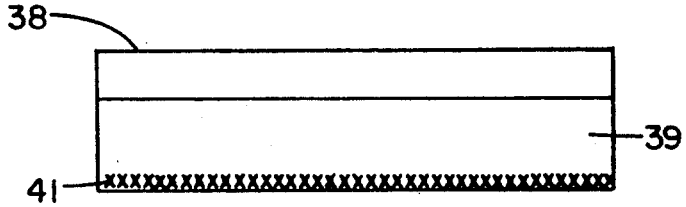
Figure 8A:
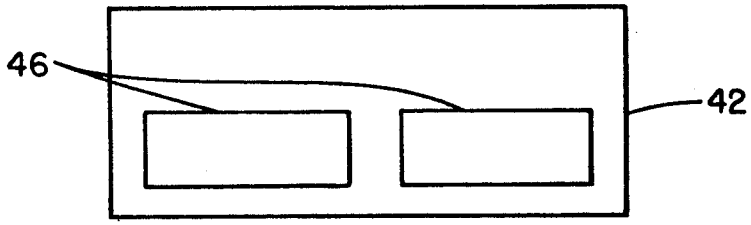
FIGS. 8*a* and 8*b* illustrate, respectively, a top plan view and a front view of a further embodiment of the invention.
Figure 8B:
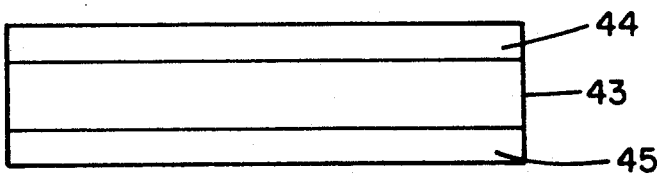

FIG. 6 relates to a seal which has already been applied to a check 30 which is schematically represented. This seal comprises a larger lamina 31 and a smaller lamina 32. The check can be a personal check, an accounts-payable check or a bank check. Hereby, the seal constitutes a complementary part of the blank check, which has a distinctive mark 33 and bears a number 34 with prefix 35 on both laminas which must match the number 36 on the same check, so that the presence of the mark 33 on the check dictates that the latter demands the application of the co-numbered seal in order to be valid. The signature of the drawer is to be superimposed on the number 34 with the prefix 35 of the smaller lamina 32 and therefore this number becomes the attestation or verifying number.

FIGS. *7a* and *7b* represent a seal that is adapted only for pre-signed bank checks. This seal is constituted of one card 37 comprising a single carrier 38 and a lamina 39 having a single number 40 which matches the exact number of the bank check (not shown). Reference numeral 41 indicates the adhesive layer, which is of the kind activated either by heat or by wetting prior to the application thereof.

FIGS. *8a* and *8b* represent a seal which is applicable for use on personal identity documents and is constituted of one card 42 comprising a single lamina 43, a single carrier 44 and a single liner 45. This seal bears two identical numbers 46; namely, the number on the left side which is intended to be placed, at least partially, on the photograph and the attestation number on the right side upon which the signature of the authority issuing the document must to be superimposed in order to validate the document itself.

In addition to the preferred embodiments of the invention as disclosed herein, it is of course understood that various modifications and changes in form or detail could readily be made without departing from the invention. It is therefore intended that the invention is not limited to the exact form and detail as shown and described therein, nor to anything less than the whole of the invention as herein disclosed and claimed.

What is claimed:

1. Transparent tamperproof seal for the protection of signed texts and documents, including personal checks, accounts-payable checks and bank checks; comprising at least one card having on one side thereof at least one adhesive inking and varnishing multilayer lamina which is at least partially transparent, and a detachable sheet-like carrier made of transparent plastic material, and on the other side including a delayed-action adhesive selected from the group of pressure-sensitive adhesives which is protected by a liner, heat-activated adhesives and moisture-activated adhesives, said lamina being applicable over the text with the subsequent removal of the carrier and bearing, in the presence of an identical number with prefix set in a position selected within and outside the seal, a number with a prefix forming a verification; and an adjacent background covering stripe, upon which number and stripe a signature is to be superimposed, the number of said seal being imposed by non-impact printing means in a preselected sequence so as to be individual and unmistakable, and said prefix being obtained by an ink transference upon detaching of the carrier.

2. Transparent tamperproof seal as claimed in claim 1, comprising three of said cards, one of said cards being larger than the other two cards which are alternatively utilized on the signature line of negotiable or non-negotiable checks, said larger card including a transparent adhesive inking and varnishing multilayer lamina and the other two cards having analogous laminas which are partially transparent each said lamina positioned on a carrier and bearing an identical number with prefix and a liner, the adhesive inking and varnishing multilayer lamina of the larger card being applicable with the subsequent removal of the carrier onto the check in order to protect the authenticity of amounts written out in letters on said check, the currency specification and the name of a payee, the adhesive inking and varnishing multilayer lamina of the second card selected between said two smaller ones being applicable, with the subsequent removal of the carrier, onto the area of the signature which is to be superimposed by the drawer directly on said lamina upon both the number with the prefix and upon an adjacent background covering stripe, and the adhesive inking and varnishing multilayer lamina of the third card being applicable, after effecting said removals of the carriers on a check stub for recording purposes.

3. Transparent tamperproof seal as claimed in claim 1 or 2, wherein that the numbers on the seal are obtained through the intermediary of a computerized ink jet head.

4. Transparent tamperproof seal as claimed in claim 2, wherein that adhesive inking and varnishing multilayer lamina of the larger card which is applied on the text, document or check has a transparent varnishing layer on the surface thereof revealing a characterizing micro-embossed pattern rendered visible only upon detaching the carrier and which inhibits any counterfeiting of the seal and any duplication of the sealed document by photostatic processes.

5. Transparent tamperproof seal as claimed in claim 2, wherein for checks the smaller card bearing the lettering "NOT NEGOTIABLE" on the adhesive inking and varnishing multilayer lamina presents proximate the number with prefix, an accessory symbol relating the non-negotiable nature of the check protected by the signature of the drawer.

6. Transparent tamperproof seal as claimed in claim 2, wherein said prefix is obtained by a selective ink transference.

7. Transparent tamperproof seal as claimed in claim 2, wherein said adhesive inking and varnishing multilayer laminas when positioned on a carrier, comprise:

(a) a transparent varnishing layer which is applied onto the respective carrier and is micro-embossed only on the area of the larger card;

(b) at least one inking layer which is slightly pigmented;

(c) points of pigmented ink in solution ejected by a computerized head to at least impart a respective number to each multilayer lamina;

(d) and a discontinuous layer of a transparent adhesive coating in separate zones maintaining an adhesive tack at temperatures in the range of from about −40° C. to +100° C.

8. Transparent tamperproof seal as claimed in claim 2, wherein at least the adhesive inking and varnishing multilayer laminas of both the larger card and the smaller card with the lettering "NOT NEGOTIABLE" thereon comprises below the adhesive layer and the pointed numbers, two further layers which respectively are constituted of tracts of soft undryable black ink so as to form a guiding line for enabling the correct positioning of the seal on the check and said lettering on the smaller lamina, such ink being subject to spreading on the paper responsive to the application of mechanical pressure or surface erasure, and by a slightly pigmented anti-scratch varnish which is reactive to Wood light.

9. Transparent tamperproof seal as claimed in claim 1 or 2, for the rapid application thereof onto checks, wherein said seal consists of one stripe comprising at least two cards each with respective laminas, one said card being larger and generally rectangular; said laminas being longitudinally joined by partial die cuts and having on one side thereof a transparent carrier, and on the other side thereof including a delayed-action adhesive selectively provided with a liner.

10. Transparent tamperproof seal as claimed in claim 9, wherein the smaller lamina bears the lettering "NOT NEGOTIABLE".

11. Transparent tamperproof seal as claimed in claim 10, wherein both the smaller lamina bearing respectively the lettering "NOT NEGOTIABLE" and the smaller lamina without said lettering are longitudinally joined together on either one side or on opposite sides of the seal.

12. Transparent tamperproof seal as claimed in claim 8, wherein the slightly pigmented varnishing layer which is incorporated in the laminas is selectively constituted of different colors in order to distinguish the denomination, such as the maximum value of a bank check.

13. Transparent tamperproof seal as claimed in claim 1, wherein said seal is applicable on personal checks, accounts-payable checks and bank checks and forms the complementary part of a blank check bearing a verifying number with prefix, and an adjacent background covering stripe to match the number on the check.

14. Transparent tamperproof seal as claimed in claim 1, wherein said seal is automatically applicable on presigned bank checks, said seal being constituted of a single card comprising, in addition to the carrier, a single transparent adhesive inking and varnishing multilayer lamina, having a verifying number with prefix matching the number of the bank check on which it is applied, said lamina comprising an adhesive coating which is activated prior to use by either heat or wetting.

15. Transparent tamperproof seal as claimed in claim 1, wherein said seal is applicable to identity documents, such as passports, drivers licenses and the like, said seal being constituted of a single card comprising a single adhesive inking and varnishing multilayer lamina which is partially transparent, said single lamina bearing two numbers identical to the document's number, of which one number is positioned at least in part, on a photograph of the document and the other number, appears beneath the signature of the authority issuing said document in order to attest to the validity of the document through the numbering correspondence between the document and the seal.

* * * * *